US005530535A

United States Patent [19]

Matsuoka

[11] Patent Number: 5,530,535

[45] Date of Patent: Jun. 25, 1996

[54] DRIVE CONTROL FOR SHEET-CONVEYING ENDLESS BELT

[75] Inventor: Teruhiko Matsuoka, Chiba, Japan

[73] Assignee: Sharp Kabushiki Kaisha, Japan

[21] Appl. No.: 407,633

[22] Filed: Mar. 21, 1995

[30] Foreign Application Priority Data

Mar. 31, 1994 [JP] Japan ..... 6-063513

[51] Int. Cl.[6] ..... G03G 15/16; B65H 5/02

[52] U.S. Cl. ..... 355/275; 271/273; 271/265.01; 271/265.02; 355/208

[58] Field of Search ..... 355/271, 274, 355/275, 208; 271/271, 273, 275, 265.01, 265.02

[56] References Cited

U.S. PATENT DOCUMENTS

| | | | |
|---|---|---|---|
| 4,515,460 | 5/1985 | Knechtel | 355/274 X |
| 5,189,470 | 2/1993 | Matsuda et al. | 355/208 |
| 5,216,453 | 6/1993 | Itoh | 355/271 X |
| 5,294,958 | 3/1994 | Isobe et al. | 355/208 |
| 5,435,542 | 7/1995 | Van Pham et al. | 271/273 X |

FOREIGN PATENT DOCUMENTS

| | | |
|---|---|---|
| 57-119351 | 7/1982 | Japan . |
| 3-179476 | 8/1991 | Japan . |
| 4-121767 | 4/1992 | Japan . |
| 4-204978 | 7/1992 | Japan . |

*Primary Examiner*—Joan H. Pendegrass
*Assistant Examiner*—Sophia Chen

[57] ABSTRACT

An endless belt which stays separated from a photoreceptor and is made to press the photoreceptor as required is wound around driving and driven rollers with some slack. When a front sheet-end sensor detects a front end of a sheet, the detection signal activates the driving roller to rotate in a forward or sheet conveying direction while the driven roller is kept in the stopped mode. By this rotation, the slack is canceled so that the endless belt presses the photoreceptor, setting up a sheet conveying mode. When a rear sheet-end sensor detects a rear end of the sheet, the driving roller is turned in the reversed direction. By this operation, the endless belt is loosened to separate from the photoreceptor.

7 Claims, 3 Drawing Sheets

DRIVE CONTROL FOR SHEET-CONVEYING ENDLESS BELT

BACKGROUND OF THE INVENTION (1) Field of the Invention

The present invention relates to a sheet-conveying device which holds a sheet-like material between rotating members to convey it. The invention is directed in particular to a sheet-conveying device in which a rotatable pressing member is provided to press a rotating roller so that a sheet is held and conveyed between the pressing members.

(2) Description of the Prior Art

A typical image recording apparatus is constructed such that; a toner image formed on a recording medium is transferred onto a sheet-like material, a plain paper sheet, for instance, then the toner image held on the copy sheet is fixed thereto and the toner-fixed sheet is discharged from the apparatus. To achieve this sequence, a sheet conveying path is formed along which a sheet-like material is fed to the image forming station and the image-formed sheet is conveyed through the fixing portion and discharged and there are some sheet-like material conveying devices in the sheet conveying path.

Here, one of means for conveying sheets is constructed of a rotating roller and a driven roller, and the driven roller is pressed against the rotating roller so that a sheet: delivered to the nip of the rollers is held and conveyed therebetween. Another means for conveying sheets is provided as a fixing means which comprises a heat roller for heating and fixing a toner image transferred to a sheet and a pressing roller pressing the heat roller for pressing the sheet bearing the aforementioned toner image and fixes the toner image while conveying the sheet.

Other than those described above, a photoreceptor as a recording medium and a transfer roller serve as a sheet conveying means. In some configurations, a transfer roller is provided for pressing the sheet against the surface of the photoreceptor with a toner image formed thereon in order to increase the transfer efficiency of toner image. That is, the transfer roller and the rotating photoreceptor hold the sheet therebetween and transfer the toner image to the sheet while conveying the sheet.

In this case, the sheet is held between and conveyed by the photoreceptor and the transfer roller while the toner image is transferred to the sheet surface. Since the transfer roller is pressed against the photoreceptor, there is a fear that toner particles on the photoreceptor might adhere to the transfer roller. That is, when a sheet to be conveyed is present between the transfer roller and the photoreceptor, toner is transferred to the sheet and no toner transfers to the transfer roller. When a leading end or rear end of the sheet passes through the nip, the photoreceptor and the transfer roller come in pressing contact with each other, and some toner transfers to the transfer roller. Alternatively, if a sheet jams as the sheet is conveyed, the toner image formed on the photoreceptor comes in direct contact with the transfer roller without any sheet therebetween and toner adheres to the transfer roller at the time.

To avoid such adherence of toner to the transfer roller, in some configurations, the transfer roller is provided so that the roller may press the photoreceptor only when it is needed and is kept away from the photoreceptor when it is unneeded. Japanese Patent Application Laid-Open Hei 4 No.204,978 discloses a mechanism for causing a transfer roller to abut against and separate from the photoreceptor on demand. This contact/separation mechanism allows the transfer roller to press the photoreceptor during the image forming and separate from the photoreceptor when no image forming is effected, in order to inhibit toner from adhering to the transfer roller. Besides, toner having adhered to is cleaned by a cleaning brush which is always abutted against the transfer roller.

Japanese Patent Application Laid-Open Hei 4 No.121,767 discloses a transfer belt of belt charging type. This transfer belt is to obtain a good printed image without polluting the transfer belt. To achieve this, semiconductive section is provided at least on one side of the transfer belt. During the transfer operation, the belt is charged so that the static electricity attracts the belt to press the image supporting medium. When no transfer operation is effected, the belt is grounded by a grounding means so that the static charges on the semiconductive section are discharged to the ground. As charges flow away, the static force having pressed the sheet goes out and the transfer belt moves away from the image supporting medium.

In order to reduce the stretch or extension of an endless belt in a printer, it is disclosed in Japanese Patent Application Laid-Open Hei 3 No.179,476 that a tension roller movable up and down is controlled by using a cam mechanism to regulate the tension of the endless belt.

In the sheet conveying means in the form of a heat-fixing device, the pressing roller is adapted to press the heat roller all the time in order to fuse and fix the toner image onto the sheet. Hence, the surface of the heat roller is composed of a relatively soft elastic material such as a silicone rubber and the like to secure a proper contact width (or nip width) with the heat roller. Since the pressing roller is pressed against the heat roller all the time, the surface of the pressing roller tends to yield or deform due to the heat when the pressing roller does not rotate or when no image forming is effected. To deal with this, a proposal has been made in which the pressing roller is made to separate from the heat roller in the non-image-forming mode. Specifically, in the description of the prior art of a microfilm disclosed in Japanese Utility Model Application Laid-Open Sho 57 No.119,351, a fixing means was illustrated in which a pressing roller is made to press a fixing roller (heat roller) by a pressing means made of springs and a solenoid during only the fixing operation.

Thus, according to the prior art, in either of the sheet conveying means made of a photoreceptor and a transfer roller or belt or the sheet conveying means made of a heat roller and a pressing roller, a pressing member pressing a rotating body is provided in such a manner as to press the rotational body or separate from the body as required. For the pressing member to press or separate from the rotating body, the pressing member as well as its supporting member is constructed in such a way as to integrally move to and from the rotating body. This requires a separate means for controlling the movement between the contacted state and the separated state. As a result, the shifting mechanism etc. becomes complicated and also requires increased cost.

SUMMARY OF THE INVENTION

In view of the drawbacks described above, it is therefore an object of the present invention to provide a sheet-conveying device which does require no moving mechanism for causing a pressing member to press a rotational body and separate therefrom and in which components of the pressing member are utilized to realize pressing and separating operations relative to the rotational body without using any separate special means, whereby the cost is reduced.

It is another object of the present invention to provide a novel pressing member and to construct a sheet-conveying device in which the features of the pressing member are used to change the state of the pressing member itself between a pressed state and a separated state relative to a rotational body.

The present invention has been achieved to attain the above objects and in accordance with a first aspect of the present invention, a sheet-conveying device for conveying a sheet as holding it between a rotational body and a pressing member, comprises: a rotational body; a pressing member turning and pressing the rotational body, the pressing member being capable of pressing the rotational body and being separated from the rotational body; and a drive control means for controlling rotational operations, wherein the pressing member comprises: an endless belt; and at least a pair of rollers around which the endless belt is wound with a slack, one of the rollers being a driving roller, and the drive control means controls the driving roller so that the endless belt is pressed onto and separated from the rotational body.

In accordance with a second aspect of the present invention, a sheet-conveying device for conveying a sheet as holding it between a rotational body and a pressing member comprises: a photoreceptor which is rotated as being formed with a toner image; a pressing member for pressing a sheet delivered on demand onto the photoreceptor in order to transfer the toner image to the sheet; the pressing member comprising: an endless belt and at least a pair of rollers around which the endless belt is wound with a slack, one of the rollers being a driving roller; a front sheet-end sensor for detecting a front end of a sheet conveyed by the endless belt; a rear sheet-end sensor for detecting a rear end of a sheet with a toner image transferred; and a driving roller control means which, based on the signals from the front and rear sheet-end sensors, controls the driving roller on the rotation, rotational direction and the like in order to cause the endless belt to press the photoreceptor or separate from the photoreceptor.

In the thus constructed sheet-conveying devices, any of the following features is effective:

In the sheet-conveying device, the driving roller control means controls the driving roller in such a manner that, in response to the detection signal of the front sheet-end sensor, the driving roller is driven in the sheet conveying direction in order to cause the endless belt to press the photoreceptor and in response to the detection signal of the rear sheet-end sensor, the driving roller is driven in the reverse direction for a predetermined period of time.

In the sheet-conveying device, the pair of rollers comprises a driving roller disposed on the forward side in the sheet conveying direction and a driven roller on the sheet entrance side.

In the sheet-conveying device, both ends of the pair of rollers are provided with projections at equidistant intervals while the endless belt is provided with perforations along both sides thereof at intervals of the distance between the neighboring projections and the perforations are mated with the projections.

In the sheet-conveying device, the driven roller is axially supported in a freely rotatable manner, and the device further comprises a lock mechanism for locking the rotary shaft of the driven roller and a lock control circuit for controlling activation and deactivation of the locking mechanism.

In the sheet-conveying device, the driven roller is axially supported in such a manner that, when the driving roller is driven in the reverse direction, the driven roller does not rotate freely and when the driving roller is driven in the forward direction, the driven roller is restrained from rotating as if it were braked until the endless belt is stretched so tight that the driving force is transmitted to the driven roller.

In accordance with the sheet-conveying device of the present invention, when the driving roller disposed on the forward side in the sheet conveying direction is activated, the endless belt which is wound around the rollers to press the rotational body such as a photoreceptor, moves and conveys a sheet as holding it in corporation with the photoreceptor. In this case, as the driving roller is turned, a slack in the opposite side of the endless belt to the photoreceptor is canceled so that the side of the endless belt is stretched tightly. Accordingly, the endless belt presses the sheet against the photoreceptor and conveys the sheet as holding it therebetween.

When the device is in the rest mode or the sheet is not conveyed, the driving roller is turned in the reverse direction for a predetermined period of time so as to create a slack on the opposite side of the endless belt to the photoreceptor. By the reverse rotation, the opposite side of the endless belt to the photoreceptor is loosened and therefore separated from the photoreceptor.

When, in particular, the endless belt is to be tightened, the front sheet-end sensor, as detecting the front end of a sheet, sends out a detection signal of a need of conveying the sheet. This detection signal activates the driving roller to turn in the sheet conveying direction. When the driving roller rotates and if the other roller is locked so as not to rotate, the slack in the opposite side of the endless belt to the photoreceptor is canceled to cause the endless belt to press the photoreceptor. In this pressed state, the sheet is held and conveyed between the belt and the photoreceptor while the toner image on the photoreceptor is transferred to the sheet.

When the transfer operation is complete, the rear end of the sheet is detected by the rear sheet-end sensor in order to stop the sheet conveying operation. Triggered by a signal from the rear sheet-end sensor, the driving roller turns in the reverse direction for a predetermined period of time in order to loose the endless belt and thereby make the belt separate from the photoreceptor. By this operation, the opposite side of the endless belt to the photoreceptor is loosed whereby the endless belt is freed from the pressed state against the photoreceptor and becomes away from the photoreceptor.

DESCRIPTION OF THE PREFERRED EMBODIMENTS

Figure 1:
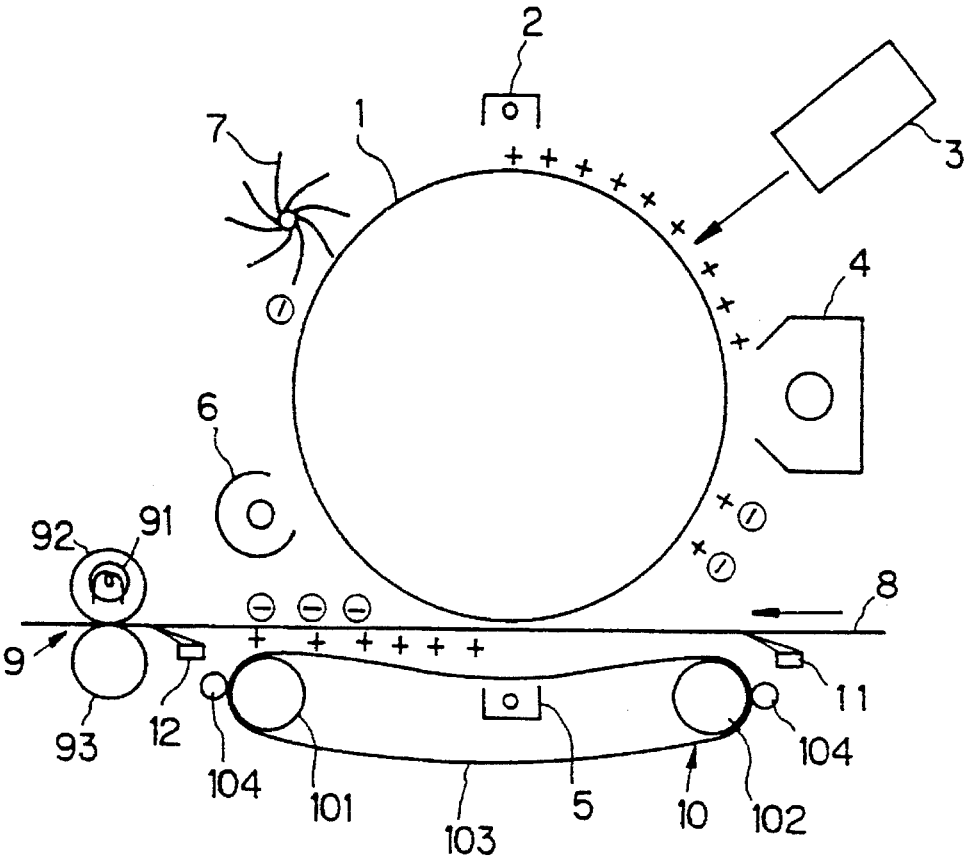
FIG. 1 is a sectional view showing an overall configuration of an image forming apparatus equipped with a sheet conveying device of the present invention.

A sheet conveying device of the present invention will hereinafter be described in detail with reference to the accompanying drawings. FIG. 1 is an overall sectional view showing an embodiment of a sheet conveying device for use in an image forming apparatus in accordance with the present invention.

Referring to FIG. 1, the image forming apparatus includes: a cylindrical photoreceptor 1 as a recording medium; a charger 2 for charging the photoreceptor surface with a specified polarity; a light emitting unit 3 for irradiating the photoreceptor surface with a laser beam, LED arrays or the like in conformity with image forming information; a developing unit 4 for toner-developing an electrostatic latent image formed on the photoreceptor by the irradiation; a transfer charger 5 for transferring toner-image formed on the photoreceptor to a sheet-like material; a charge eraser 6 using light or corona discharge for erasing charges remaining on the photoreceptor surface; and a cleaning unit 7 for cleaning toner particles remaining on the photoreceptor surface to prepare the photoreceptor for a next image forming.

In order to deliver a sheet to a position of the transfer charger 5, a sheet feeding means is provided which feeds a topmost sheet 8 from those accommodated in, for example, an unillustrated sheet tray. The thus delivered sheet 8 is guided along the surface of the photoreceptor 1 near the transfer charger 5 to the passage between the photoreceptor 1 and the transfer charger 5 where the toner image formed on the photoreceptor 1 is transferred to the sheet 8 by the function of the transfer charger 5. The sheet 8 with toner transferred thereto is separated from the surface of the photoreceptor 1 to be delivered to a heat-fixing unit 9. The heat-fixing unit 9 heats and fuses the unfixed toner image on the sheet 8 to fix it. In this while, the sheet 8 is conveyed by the heat-fixing unit 9 while the toner image on the sheet is successively fixed. The sheet with the toner image fixed is discharged through conveyer rollers (not shown) to a discharge sheet tray.

The heat-fixing unit 9 comprises, as illustrated, a heat roller 92 incorporating a heater 91 therein and a pressing roller 93 pressed against the heat roller with a proper pressing force. The heat roller 92 and the pressing roller 93 hold the toner-transferred sheet therebetween and convey it while the toner image on the sheet is fused and fixed by the heat from the heat roller 92.

In order to transfer the toner image formed on the photoreceptor 1 onto the sheet 8, a pressing member 10 is provided which presses the delivered sheet 8 toward the photoreceptor 1 to convey it. The pressing member 10 and the photoreceptor 1 constitute the sheet conveying device of the present invention.

The pressing member 10 is constructed of rotatable rollers 101 and 102 and endless belt 103 loosely wound around these rollers. Here, the rollers 101 and 102 are disposed ahead of and behind the transfer charger 5, respectively. The roller 101 which is disposed on the forward side in a sheet conveying direction or on the sheet exit side is coupled with an unillustrated driver motor via a rotation transmitting means and is rotated thereby so that the endless belt 103 moves in the same velocity with that of the photoreceptor surface at their meeting point. The roller 102 on the opposite side or on the sheet entrance side is a driven roller which is supported rotatably and has an interlock means such as a brake for locking the rotation as requested.

The endless belt 103 is wound between the rollers 101 and 102 with a proper slack. Therefore, there is a fear that the roller 101 and 102 might slip relative to the endless belt 103. In order to avoid this, or to drive the endless belt 103 properly, a pair of pressing rollers 104,104 is provided respectively for each roller 101 or 102 so as to press the endless belt against each of the rollers 101 and 102. As the driving roller 101 turns in the counterclockwise direction, the endless belt 103 runs in the sheet conveying direction or in a direction shown by an arrow in the figure. At that time, if the driven roller 102 is locked by a brake etc., so as not to turn, the upper stretch of the running endless belt 103 or the side of the belt opposed to the photoreceptor 1 is tightened, whereby the part of the belt comes in pressing contact with the photoreceptor 1. Conversely, the rollers 101 and 102 are so arranged that the upper part of the endless belt 103 is brought into contact with the photoreceptor 1 when the upper part is tightened.

Specifically, the rollers 101 and 102 are placed so that the transfer charger 5 opposed to the photoreceptor 1 may become positioned in the middle point between the two rollers and a tangent line to the photoreceptor at the point opposed to the transfer charger may coincide with a line which is drawn by connecting the topmost points of the two rollers 101 and 102. In this arrangement, when the endless belt 103 is stretched tightly between the rollers, the belt comes into contact with the photoreceptor 1 at the point opposed to the transfer charger 5. In this situation, if the contact width is to be taken large, it is possible to rearrange the rollers 101 and 102 so that the line defined between the topmost points of the rollers may be located above the tangent line to the photoreceptor 1. Thus, the adjustment of the contact width can be easily done by adjusting positions of the rollers.

The roller 101 is used as a driving roller. The driving roller 101 is normally driven by a motor in such a direction as to convey the sheet 8 in the direction of the arrow. When no sheet is required to be conveyed, the endless belt 103 should be kept away from the photoreceptor 1. To create this state, the driving roller 101 is driven in the reverse direction with the driven roller 102 locked.

For the endless belt 103 to be driven properly without slipping by the driving roller 101, the aforementioned pressing roller 104 is provided for each of the driving rollers 101 and driven roller 102. As a result, the endless belt 103 is held between respective pair rollers 101 and 102 to prevent slip of the endless belt 103 relative to rollers 101 and 102.

Figure 2:
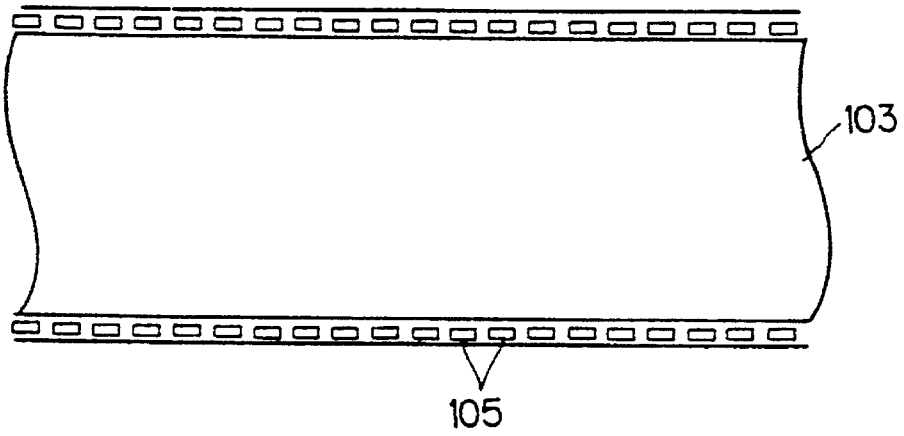
FIG. 2 is a front view showing an example of an endless belt as a constituent of a sheet conveying device of the present invention.
Figure 3:
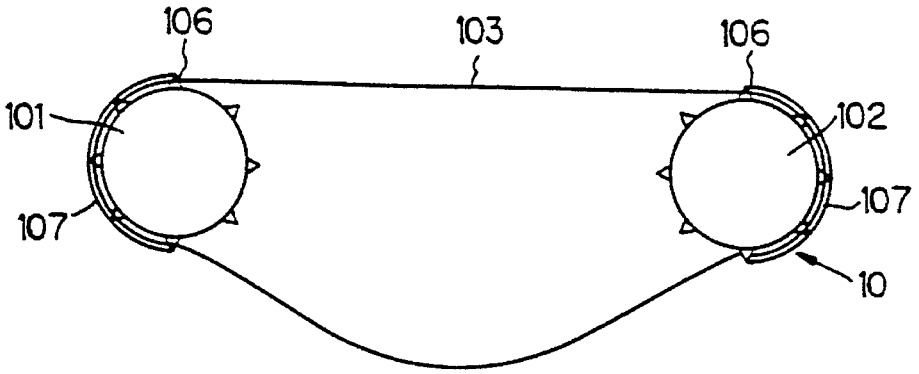
FIG. 3 is a side view showing a means for driving an endless belt as a constituent of a sheet conveying device of the present invention.

Techniques for preventing slip of the belt 103 are not limited to the above method but can be done by other configurations. For example, as shown in FIGS. 2 and 3, both ends of the rollers 101 and 102 are provided with projections 106 at equiangular intervals while the endless belt 103 is provided with perforations 105 (see FIG. 2) along both sides of the belt at intervals of the distance between the neighboring projections 106. The perforations 105 thus formed in the endless belt 103 are mated with the projections 106, whereby it is possible to prevent the driving roller 101 from slipping relative to the endless belt 103 or from idling. In FIG. 3, designated at 107 is a cover provided for the projections 106 to prevent the endless belt 103 from dropping off the projections 106.

Since the endless belt 103 is pressed against the photoreceptor, the endless belt 103 is preferably formed of a material that does not attract toner particles from the photoreceptor surface. Therefore, the endless belt should be formed of a material having a good parting performance.

Examples of such materials include: fluorocarbon polymers represented by a polytetrafluoroethylene (PTFE) film; a polyethylene terephthalate (PET) film; a polyimide film.

In FIG. 1, reference numerals 11 and 12 designate sensors made of micro switches or the like. The sensor 11 detects entrance of a sheet 8 to the belt conveying section toward the transfer station while the sensor 12 detects exit of the sheet 8 from the belt conveying section after the transfer station. More specifically, the sensor 11 is disposed just before the entrance of the pressing member 10 to detect the front end of the sheet 8 and the sensor 12 is disposed just after the exit of the pressing member 10 to detect the rear end of the sheet 8 after the transfer operation.

Figure 4:
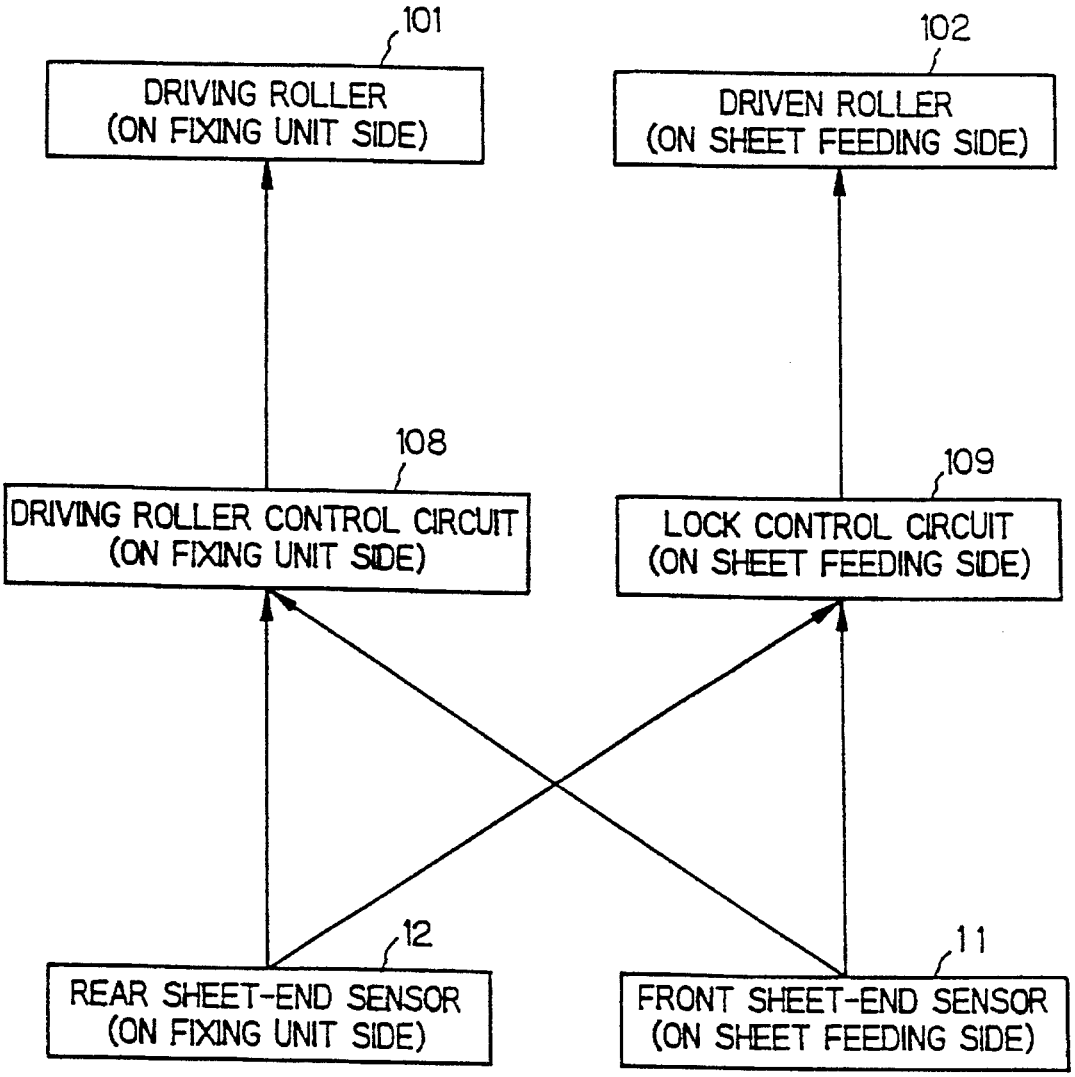
FIG. 4 is a block diagram illustrating switching control of an endless belt between a separated state and a pressed state in a sheet conveying device of the present invention.

FIG. 4 is a block diagram illustrating switching control of the endless belt 103 between the separated state or the pressed state. A driving roller control circuit 108 is to control the motion of a motor for driving the driving roller 101 and controls the direction of rotation, i.e., forward rotation (the direction in which the sheet 8 is conveyed) and reverse rotation (opposite direction to the sheet conveying direction), the speed of rotation etc. The control circuit 108 operates in response to detection signals from the front and rear sheet-end sensors 11 and 12 for detecting the state of the sheet 8.

A lock control circuit 109 is to control the motion of the driven roller 102. That is, the lock control circuit 109 switches the state of the roller 102 between the locked state and the unlocked state in response to the detection signals from the front and rear sheet-end sensors 11 and 12.

The driven roller 102 is axially supported so as to be rotatable at the normal state and has a locking mechanism for locking the rotation thereof as required. In place of providing the locking mechanism, it is possible to restrain the rotation of the driven roller 102 by acting proper braking forces thereon. That is, when the driving roller 101 rotates in the reverse direction, the driven roller 102 is set to be fixed, and when the driving roller 101 is driven in the forward direction, the driven roller 102 is set to be properly braked to limit the rotation until the endless belt 103 is stretched so tightly as to transmit the driving force to the driven roller 102. This configuration with such setup does neither require the lock control circuit 109 nor the locking mechanism.

Figure 5:
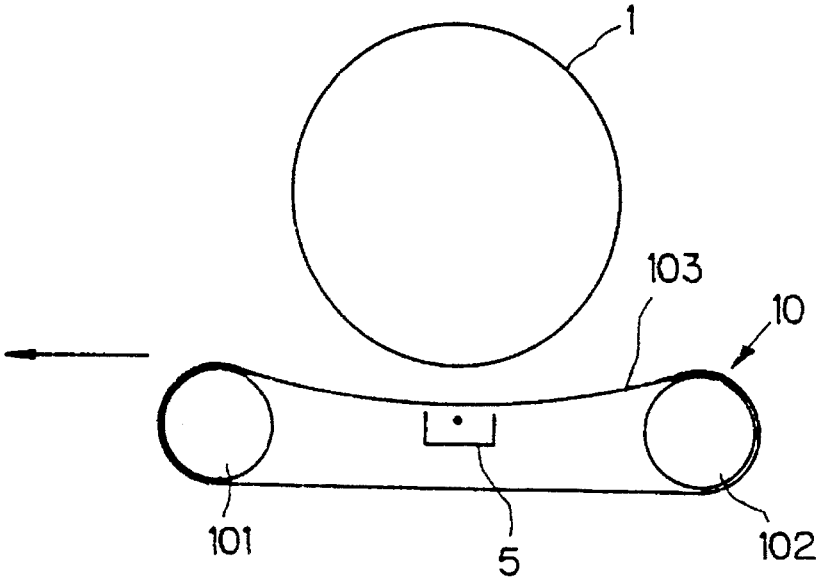
FIG. 5 is an illustrative view showing the separated state of the endless belt when no sheet is conveyed by a sheet conveying device of the present invention.
Figure 6:
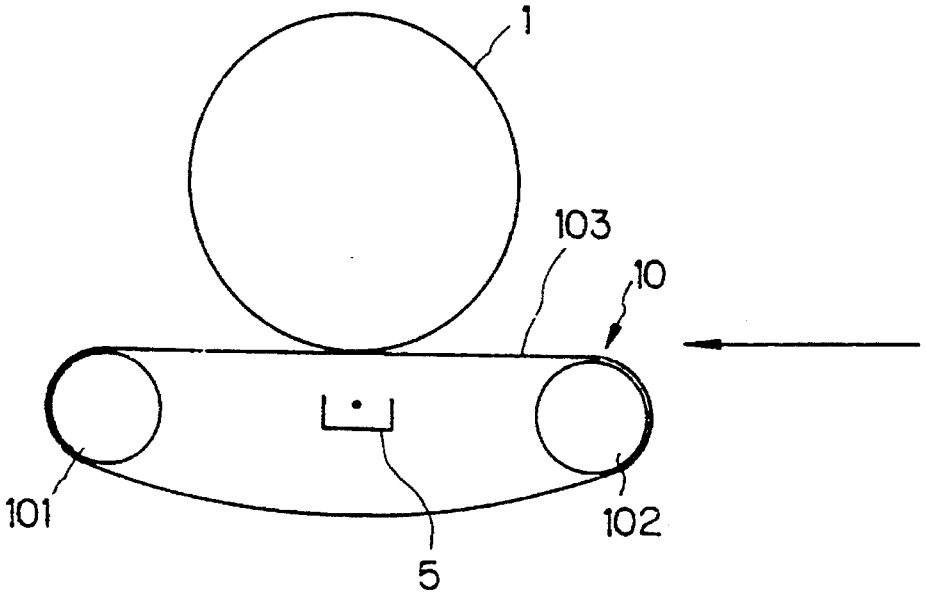
FIG. 6 is an illustrative view showing the pressing state of the endless belt when a sheet is conveyed by a sheet conveying device of the present invention.

Referring now to FIGS. 5 and 6, description will be made on the operation of controlling the conveyance of the sheet 8 by the photoreceptor 1 and the pressing member 10 thus configurated.

As the image forming operation is started in the image forming apparatus such as a laser printer, for instance, the photoreceptor 1 is rotated and the surface of the photoreceptor 1 is uniformly charged by the charger 2 so that the photoreceptor 1 is prepared to be written in with image information. The thus charged photoreceptor 1 is illuminated by modulated laser beams including desired image information, emitted from the light emitting unit 3, so that an electrostatic latent image is drawn on the photoreceptor. The electrostatic latent image is visualized with toner in the developing unit 4.

The toner image formed on the surface of the photoreceptor 1 is moved to the station where the transfer charger 5 causes the toner image to transfer to the sheet 8 delivered by the paper feeding portion. In synchronism with the movement, the sheet 8 is fed. When the sheet 8 reaches the position of the front sheet-end sensor 11, the sensor 11 detects the front end of the sheet 8. At that time or before, the endless belt 103 is kept away from the photoreceptor 1 as shown in FIG. 5, but in response to the detection, the endless belt 103 in its loose state is tightened so as to press the photoreceptor 1. To tighten the belt, the driving roller 101 is activated to turn while the roller 102 is set locked or the rotation of the roller 102 is restrained.

That is, the detection signal by the front sheet-end sensor 11 activates the driving roller control circuit 108 and the lock control circuit 109. The driving roller control circuit 108 drives the driving roller 101 in the forward direction and the lock control circuit 109 locks the roller 102 to restrain it. By these operations, the loose endless belt 103 is tightened by the rotation of the driving roller 101 and made tense between the rollers 101 and 102 so as to press the photoreceptor 1 in opposition to the transfer charger 5. The pressing state is shown in FIG. 6. The formation of this state can easily be distinguished based on the driving time etc. of the roller 101. For example, when the endless belt 103 is kept loose, with about 10 mm extra length given to the belt for the span between the rollers 101 and 102, and if the span between the rollers 101 and 102 is assumed to be 100 mm, the endless belt 103 becomes positioned about 20 mm away from the surface of the photoreceptor 1 at the position of the transfer charger 5.

From this state, the driving roller 101 is rotated with the roller 102 locked until the extra length of 10 mm is carried away. Then, the locked state of the roller 102 is released and the sheet 8 can be conveyed along the endless belt 103 toward the transfer station facing the photoreceptor 1. The sheet 8 brought to the transfer station is held between the endless belt 103 and the photoreceptor 1 and the toner image formed on the photoreceptor 1 is transferred to the sheet 8 by the function of the transfer charger 5.

After the sheet 8 with toner transferred passes by the transfer zone of the photoreceptor 1, the rear end of the sheet is detected by the rear sheet-end sensor 12. When the sensor 12 detects that the sheet 8 passes by, the detection signal is sent out for the driving roller control circuit 108 and the lock control circuit 109. In response to the detection signal, in order to part the endless belt 103 from the photoreceptor 1, the driving roller 101 is driven in the reverse direction for a predetermined time. This driving time for the reverse rotation is to give a 10 mm slack for the roller span. In this state, the operation of the transfer charger 5 is complete and the roller 102 is set locked. Accordingly, the endless belt 103 is kept away from the photoreceptor 1 as shown in FIG. 5, therefore there is no fear that the residual toner on the photoreceptor might be transferred to the endless belt 103.

Next, the sheet 8 is conveyed to the heat-fixing device 9, where the sheet 8 with the toner image is heated and fixed as being conveyed. Then, the sheet is discharged outside the printer. In this cycle, if, when the rear sheet-end sensor 12 detects the rear end of the sheet 8, the front sheet-end sensor 11 has already detected the front end of a next sheet, the formation of the slack in the endless belt 103 is skipped and the driving roller 101 is kept on rotating so that the endless belt 103 keeps pressing the photoreceptor 1.

Although the slack length for causing the endless belt 103 to part from the photoreceptor 1 was specified as 10 mm long in the description above, this amount can be determined depending on the system. That is, to secure a separating distance of at least 5 mm or more between the photoreceptor 1 and the endless belt 103 at the transfer station, the slack amount is at least about 0.2 mm or more if the distance between the rollers 101 and 102 is assumed to be 100 mm. To make the endless belt 5 mm or more away from the surface of the photoreceptor, the driving roller 101 is driven in the reverse direction to convey the endless belt 103 by 0.2 mm in the reverse direction.

In the above embodiment, although the slack in the endless belt 103 is formed by controlling the motion of the driving roller 101, this does not limit the present invention. As an alternative configuration, it is possible to construct a system driving the roller 102 for forming the slack. More clearly, when the slack is to be formed, the roller 102 is driven in the forward direction with the roller 101 locked. In this configuration, the driving time of the roller 102 should be determined as in the above embodiment, depending upon the slack amount to be formed. When the sheet 8 must be conveyed for transfer operation, the roller 102 is rotated in the reverse direction in order to cancel out the slack, whereby the opposite side of the endless belt 103 to the photoreceptor 1 is tightened to press the photoreceptor surface. In this while, the driving roller 101 is locked. When the belt is stretched tightly, the driving roller 101 is activated at such a speed as to convey the sheet and at the same time the roller 102 is set free to be idly driven by the rotation of the driving roller 101.

Other than the above methods, if the driving roller 101 is adapted to rotate faster than the conveying speed of the sheet when the front sheet-end sensor 11 detects the sheet, the slack of the endless belt 103 can be gradually canceled so that the endless belt 103 is stretched tightly between the rollers 101 and 102. As time required for eliminating the slack is determined by the speed of rotation and the slack amount at that time, the driving speed of the roller 101 may and should be controlled to be equal to the conveying speed of the sheet after the lapse of this time. In this case, if the roller 102 is not necessarily locked and may be set rotatable, the slack can be gradually canceled. That is, the rotational speed of the driving roller 101 should be set up faster to completely cancel the slack before the sheet 8 being conveyed reaches the transfer station of the photoreceptor 1. When the endless belt 103 is tightened to press the photoreceptor 1, the rotational speed of the driving roller 101 should be changed to the conveying speed of the sheet 8.

In the above embodiment, the toner image is electrostatically transferred to the sheet 8 by activating the transfer charger 5 through the endless belt 103. Therefore, the transfer charger 5 must be disposed through the inside of the endless belt 103, requiring a complex structure. To eliminate the drawback, it is possible to apply a voltage to the endless belt 103 itself for attracting the toner image electrostatically.

To attain the above object, the inner side of the endless belt 103, that is, the side that is in contact with the rollers 101 and 102, is made conductive, and the rollers 101 and 102 are rotatably disposed but electrically floated. In this arrangement, a predetermined voltage is applied to the belt through the roller 101 or 102. The endless belt 103 may and should be composed of one of the aforementioned fluorocarbon polymer films with a conductive layers on the side contacting with the roller 101. This configuration eliminates the necessity of the transfer charger 5, simplifies the structure and therefore reduces the cost. Besides, it is also possible to eliminate bad influences caused by the ozone gas which would be generated by the transfer charger 5.

In the foregoing description, the sheet conveying device composed of the photoreceptor 1 and the endless belt 103 as the pressing member 10 was illustrated. The present invention is not limited to the above embodiment but can be utilized in a similar configuration for the heat-fixing device 9 for fixing the toner image on the sheet. That is, the pressing roller 93 pressing the heat roller 92 may be replaced with a pressing member 10 consisting of rollers 101 and 102 and an endless belt 103. In this configuration, in order to press the endless belt 103 against the heat roller 92 as well as to secure a greater nip width, the rollers 101 and 102 are positioned so that a line connected between the topmost points of the rollers 101 and 102 may be located in some greater degree above the tangent line to the heat roller 92. Accordingly, it is possible to adjust the nip width freely regardless of the material of the endless belt 103, therefore the setup can markedly be simplified.

In the above configuration, when the front end of the sheet 8 with the toner image transferred is sensed by a front sheet-end sensor 11, the driving roller 101 is driven in the forward direction with the driven roller 102 locked so that a slack in the part of the endless belt 103 facing the heat roller 92 is conveyed away to stretch the endless belt 103 tightly and cause the belt to press the heat roller 92. After the lapse allowing the slack to be canceled, the driven roller 102 is released to be rotatable. In this state, the sheet 8 can be fed to a region where the heat roller 92 is in pressing contact with the endless belt 103 and the transferred toner image on the sheet 8 is heated and fixed as the sheet 8 is held and conveyed between the heat roller 92 and the endless belt 103.

When the rear end of the sheet with the image fixed is sensed by a rear sheet-end sensor 12 on the exit side of the fixing device, in order to part the endless belt 103 from the heat roller 92, the endless belt 103 is halted and then, after a reverse rotation of a predetermined distance, the drive stops. The rotating time for the reverse rotation is determined depending on the distance of the endless belt 103 from the heat roller 92 (or the distance immediately below the heat roller 92). Conversely, the same period of time as that for the reverse rotation is assigned for the time for the forward rotation of the driving roller 101 to cancel the slack in the endless belt 103 and press it onto the heat roller 92. After the lapse of the time, the driven roller 102 is set free to be rotatable.

Here, the method for causing the endless belt 103 to press the heat roller 92 and separate from the roller may be configurated in the same manner as for causing the endless belt 103 to press the photoreceptor 1 and separate from the photoreceptor. For example, for the endless belt 103 to be made away from the heat roller 92, the driving roller 101 is rotated in the reverse direction for a predetermined period of time. Or, after the roller 102 is driven and the driving roller 101 is halted to rotate, the roller 102 is driven in the forward direction for a predetermined period of time.

In order to press the loose endless belt 103 against the heat roller 92, if the driving roller 101 is driven faster than normal at the initial driving, the slack can be gradually canceled. The time required for eliminating the slack depends on the driving speed and the amount of slack and is set up to be equal to the time taken for the sheet 8 to be conveyed to the fixing portion of the heat roller 92. For this reason, with the slack amount fixed, the driving speed may be determined so that the elimination of the slack may finish before the sheet 8 reaches the fixing position of the heat roller. In this case, the rotation of the roller 102 is not necessarily locked and is set free to be rotatable. Further, when the slack is eliminated after a reverse rotation of the roller 102 for a predetermined period of time, the driving roller 101 may be driven in the forward direction.

The material for the endless belt 103 may be those having a good parting performance with toner, that is, those mentioned before for the material of the endless belt 103 that is pressed onto the photoreceptor 1.

In the most preferable embodiment of the pressing member 10 of the invention for causing the endless belt 103 to press the photoreceptor 1 or the heat roller 92 and part from the photoreceptor or the heat roller, the roller 101 disposed on the forward side of the sheet 8 is used as a driving roller and the roller 102 disposed on the entrance side of the sheet 8 is used as a driven roller. The driving roller 101 is turned as fast as the sheet is to be conveyed. When the rear sheet-end sensor 12 detects the rear end of the sheet, the driving roller 101 is driven in the reverse direction for a predetermined period of time to reverse the endless belt 103. When the front sheet-end sensor 11 detects the front end of a sheet, the driving roller 101 is activated. The timing of the activation of the driving roller 101 is when the endless belt 103 is pressed onto the photoreceptor 1 or the heat roller 92 before the sheet 8 enters the pressing region between the endless belt 103 and the rotational body of the photoreceptor 1 or the heat roller 92. Therefore, if the time taken for the driving roller 101 to remove the slack of the endless belt 103 is shorter than the duration in which the sheet 8 is conveyed from the detection sensor 11 to the aforementioned pressing position, the driving speed of the driving roller 101 is increased in conformity with the aforementioned timing.

In this case, if the driven roller 102 is left as halting and may turn only when the driving force is transmitted, the slack of the endless belt 103 can be canceled completely and then the driven roller 102 is driven in the timing when the endless belt 103 presses the rotational body.

Thus, when the driving roller 101 is configurated as being able to rotate in both the forward direction (the sheet conveying direction) and the reverse direction, it is not necessary for the driven roller 102 to have any locking mechanism or rotating driver means and therefore it is possible to construct a more simplified device. That is, the driven roller 102 is rotatably supported in such a manner that the roller 102 may keep on stopping and may turn only when a proper rotational force is acted. Further, since the driving roller 101 is disposed on the forward side in the sheet conveying direction, it is easily possible to create a slack on the side of the endless belt 103 opposed to the rotational body for parting the belt from the body as well as to remove the slack and tighten the belt between the rollers 101 and 102 to press the belt against the rotational body.

As has been described heretofore, according to the sheet-conveying device of the present invention, when a pressing member which is able to press the rotational body for conveying a sheet and part therefrom is to be provided, it is possible to use the driving means for conveying the sheet as it is without providing any separate, complicated means such as a shifting mechanism for integrally shifting the entire pressing member. Accordingly, with a markedly simple structure, it is possible to change the state of the pressing member between the pressed state and the separated state, and therefore the device can be reduced in cost.

Particularly, since the pressing member is constructed of an endless belt and rollers for driving the endless belt, it is possible to easily and freely set up a desirable pressing amount of the belt against a rotational body.

What is claimed is:

1. A sheet-conveying device comprising:

a rotational body;

a pressing member turning and pressing said rotational body, said pressing member being capable of pressing said rotational body and being separated from said rotational body wherein a sheet is held between and conveyed by said rotational body and said pressing member; and drive control means for controlling rotational operations, said pressing member having an endless belt and at least a pair of rollers around which said endless belt is wound with slack, one of said pair of rollers being a driving roller, said drive control means controlling said driving roller so that said endless belt is pressed onto and separated from said rotational body.

2. A sheet-conveying device comprising:

a photoreceptor which is rotated as being formed with a toner image;

a pressing member for pressing a sheet delivered on demand onto said photoreceptor in order to transfer the toner image to the sheet, the sheet being held between and conveyed by said photoreceptor and said pressing member, said pressing member having an endless belt and at least a pair of rollers around which said endless belt is wound with slack, one of said pair of rollers being a driving roller;

a front sheet-end sensor for detecting a front end of a sheet conveyed by said endless belt;

a rear sheet-end sensor for detecting a rear end of a sheet having a toner image transferred thereto; and driving roller control means, based on detection signals from said front and rear sheet-end sensors, for controlling said driving roller rotation, rotational direction and operation in order to cause said endless belt to press said photoreceptor and separate from said photoreceptor.

3. The sheet-conveying device according to claim 2, wherein said driving roller control means controls said driving roller in such a manner that, in response to the detection signal of said front sheet-end sensor, said driving roller is driven in a sheet conveying direction in order to cause said endless belt to press said photoreceptor and in response to the detection signal of said rear sheet-end sensor, said driving roller is driven in a reverse direction for a predetermined period of time.

4. The sheet-conveying device according to claim 2, wherein said pair of rollers comprises the driving roller disposed on a forward side of a sheet conveying direction and a driven roller disposed on a sheet entrance side.

5. The sheet-conveying device according to claim 2, wherein both ends of said pair of rollers are provided with projections at equidistant intervals while said endless belt is provided with perforations along both sides thereof at intervals equivalent to the equidistant intervals between said projections and said perforations are mated with said projections.

6. The sheet-conveying device according to claim 4, wherein said driven roller is axially supported in a freely rotatable manner, the sheet-conveying device further comprising:

a lock mechanism for locking a rotary shaft of said driven roller; and a lock control circuit for controlling activation and deactivation of said locking mechanism.

7. The sheet-conveying device according to claim 4, wherein said driven roller is axially supported in such a manner that, when said driving roller is driven in a direction reverse of a sheet-conveying direction, said driven roller does not rotate freely and when said driving roller is driven in the sheet-conveying direction, said driven roller is restrained from rotating as if it were braked until said endless belt is stretched so tight that driving force of said driving roller is transmitted to said driven roller.

* * * * *